United States Patent [19]

Raggio

[11] 4,392,532

[45] Jul. 12, 1983

[54] MINIMUM TEMPERATURE CORRECTION METHOD FOR LOCATING AND SETTING GAS-LIFT VALVES

[76] Inventor: Ivan J. Raggio, 2412 Yorktown, #297, Houston, Tex. 77056

[21] Appl. No.: 244,085

[22] Filed: Mar. 16, 1981

Related U.S. Application Data

[63] Continuation of Ser. No. 17,441, Mar. 5, 1979, abandoned.

[51] Int. Cl.[3] ..... E21B 43/00; E21B 43/12

[52] U.S. Cl. ..... 166/372; 166/250; 166/373; 417/54; 417/109

[58] Field of Search ..... 166/250, 314, 372; 417/54, 109, 112

[56] References Cited

U.S. PATENT DOCUMENTS

| | | | |
|---|---|---|---|
| 2,250,464 | 7/1941 | Boynton | 417/112 X |
| 3,277,838 | 10/1966 | Canalizo | 417/112 |
| 3,478,584 | 11/1969 | Strubhar et al. | 166/250 X |
| 3,646,953 | 3/1972 | Elliot et al. | 417/112 |
| 3,782,468 | 1/1974 | Kuwada | 166/314 X |
| 4,211,279 | 7/1980 | Isaack | 166/314 X |
| 4,251,191 | 2/1981 | Gass et al. | 417/54 X |

FOREIGN PATENT DOCUMENTS

| | | | |
|---|---|---|---|
| 694936 | 9/1964 | Canada | 166/314 |

OTHER PUBLICATIONS

Avcoin "The Use of Gas Lift and Flow Valves in East Texas Field", *The Oil Weekly,* pp. 44–56, May 31, 1937.

CAMCO Catalog 1952–1953, pp. 1050–1067.

*Primary Examiner*—Stephen J. Novosad
*Assistant Examiner*—George A. Suchfield
*Attorney, Agent, or Firm*—Guy E. Matthews

[57] ABSTRACT

A method for locating gas-lift valves in properly spaced manner within a string of production tubing extending to a production zone within a well. During calculations for valve spacing and set pressures, the spacing and reopening pressures of the valves are corrected to the lowest temperature that is expected to be encountered at any valve while lifting from the next lower valve of the gas-lift valve and piping system. An average between the flowing temperature corresponding to the rate to be produced from the next deepest valve and the geothermal temperature gradient are employed to calculate the reopening pressure of any given valve.

5 Claims, 17 Drawing Figures

MINIMUM TEMPERATURE CORRECTION METHOD FOR LOCATING AND SETTING GAS-LIFT VALVES

This is a continuation of application Ser. No. 17,441, filed Mar. 5, 1979, now abandoned.

FIELD OF THE INVENTION

This invention relates generally to the gas-lift method for producing liquids such as oil and water from deep wells such as petroleum producing wells. More specifically, the invention concerns a method for locating and spacing gas-lift valves within the well production tubing such that each of the set pressures and spacing calculations for the various gas-lift valves of each well are corrected in such manner that proper unloading and operating conditions will develop to the desired depth within the well, thus promoting efficient production of the well to its maximum potential of production.

BACKGROUND OF THE INVENTION

Production of oil from oil bearing earth formations is produced in many cases by the inherent formation pressure of the oil bearing formation. In many cases, however, the oil bearing formation lacks sufficient inherent pressure to force the oil from the formation upwardly through a string of production tubing and to the surface where it will be transported from a wellhead structure by flowlines. The pressure of the production zone might have been depleted, as is the case with many old oil fields. When this occurs, one method of continuing production is to provide mechanical pumping operations. Another popular method for achieving production from inadequately pressured oil bearing formations is the gas-lift method whereby gas is injected into the annulus between the production tubing and casing under controlled conditions. The tubing extending downwardly into the well to the production zone is provided with a plurality of gaslift valves that are positioned in spaced relation along the length of the tubing. Spacing and other characteristics of the gas-lift valves must be established in accordance with the criteria of the particular well involved in order to achieve production at the maximum rate that is produceable from the formation involved. For the reason that no two wells are exactly alike and may involve differences in such parameters as the height of the static liquid column within the well, the static gradient of the load fluid, i.e. liquid between the valves, geothermal temperature, etc., it is virtually a requirement that each gas-lift system for independent wells be separately calculated in order to achieve optimum production. In view of the fact that many hundreds of gas-lift installations have been made, differing design techniques have been established for designing gas-lift systems, and the techniques have progressed or become modified through the passage of time thereby resulting in other more improved techniques.

One of the early techniques for designing gas-lift installations is a technique involving graphical solutions computed by means of formula involving application of the environment of the well to the design criteria that was known at that time. This technique, referred to as the "minimum gradient method," was based on the premise that the unloading rate, i.e. ejection of the liquid column from the well down to the desired depth, was the same as the ultimate producing rate and thus the theory originated that the temperature opposite each valve would not change from one operation to the other. No allowance was made for the relatively cool load fluid nor for a high percentage of oil which loses heat at a much greater rate than water and flows at a temperature approximating geothermal temperature. Although the minimum gradient method or technique for designing gas-lift systems was considered successful, a technique that is presently referred to as the "decreasing gradient method" evolved because of the need for more efficient gas-lift installations. Prior to the decreasing gradient method, the object was to inject gas into the production tubing at the deepest possible point without sacrificing pressure to unload the kill fluid. In other words, the higher the injection gas pressure at a give point of injection (within limits), the more efficient the installation will be in terms of gas usage per fluid produced. Therefore, the trend has always been to design for ultimate operating conditions without allowing for varying temperatures while unloading resulting in valve interference which can present further unloading of the liquid column within the tubing and results in liquid production that is below the maximum production rate of the well.

From another viewpoint, gas-lift operations are based on a force balance between the gas pressure in the annulus defined between the casing and the production tubing and the fluid load in a tubing. The pressure available to cause tubing unloading from one gas-lift valve to the next deepest gas-lift valve in the tubing string can be no more than the reopening pressure of an upper gas-lift valve. If the reopening pressure is based on the highest temperature possible at the level of the upper valve and the temperature is actually less, an upper gas-lift valve can reopen at a lower pressure than is predicted, thereby improperly injecting gas into the tubing string. In this circumstance, as indicated above, the gas pressure that is needed for unloading a deeper valve is simply not available, thus the upper improperly opening valve causes unloading operations to cease before the tubing has been unloaded down to the desired depth.

Prior to development of the minimum gradient method for the design of gas-lift systems, gas-lift valve spacing was based on the following equation:

$$DBV = \frac{P_c@L - Pwh - DVA\ (S.F.)}{G_{SL}} \qquad \text{Equation 1.}$$

Calculation of the distance between valves, utilizing Equation 1 is illustrated and discussed on Pages 20–22 of the gas-lift manual of Macco Oil Tool Co., Inc. pertaining to tubing pressure operated intermittent gas-lift design theory. The distance between valves (DBV) is identified simply as the differential pressure between the casing pressure and tubing pressure divided by the static gradient of the load fluid. Therefore, it is obvious through use of the conventional equation that the utilization of gradient curves to estimate tubing pressures at each valve depth is far superior to the previous method of utilizing emperical spacing factors to determine valve spacing. Through utilization of gradient curves, gas-lift systems were enabled to predict gas volume requirements which then led to the use of varying port sizes for better control of the injection gas. The former technique involved the use of standard port sizes (usually ¼ inch and 5/16 inch) without regard to gas passage.

From the beginning established by calculations based on Equation 1, the minimum gradient method or technique was a logical progression and became a valuable tool to design engineers involved with design of gas-lift systems. The following illustrations show the design technique established by the minimum gradient method for gas-lift design. It should be noted that all design techniques are based on unloading of the well to a predetermined depth. FIGS. 12–15, which illustrate the prior art, each show a schematic at the left portion of the figure depicting a well having a gas-lift system installed therein with a corresponding depth versus pressure plot in graphical form on the right which should closely approximate the results if a pressure survey were taken at that particular stage of unloading. As shown in FIG. 12, fluid from the casing C is being transferred into the tubing T through all of the valves which are all open due to the hydrostatic head of the fluid within the casing. As shown, gas is being injected into the annulus between the casing and tubing by means of an injection conduit I and is being forced upwardly through the production tubing to the surface by the force generated by the injected gas applied to the annulus. The gradient in the tubing in this situation is equal to the zero GLR (gas liquid ratio) curve (all liquid) for the rate being unloaded. The gas liquid ratio is typically read in cubic feet per barrel from a depth-pressure traverse for a particular size of production tubing. It should be noted that the differential pressure indicated by Delta P indicated at the right side of the graphical representation in the figures is not to be misconstrued as the differential pressure that is reponsible for spacing the gas-lift valves. The differential pressure identified by Delta P ranges from 20–50 psig and is simply an allowance made so that when the fluid is unloaded from the casing to the depth of the valve, the casing pressure will remain higher than the tubing pressure so that gas can enter the tubing. Otherwise, a zero pressure differential would exist and no gas would flow into the tubing for gas-lift induced production. This phenomenon is known in the industry as a stymie condition.

Referring now to FIG. 13, which also shows gas-lift calculations in accordance with the prior art, fluid above the uppermost valve is being aerated to the surface (lower density) by injecting gas from the annulus into the tubing. Note the shift of the zero GLR curve to the left (lower pressure) above Valve #1 by the addition of gas (dashed line) while fluid continues to be trnasferred from the casing to the tubing through the lower valves. The illustration of FIG. 13 identifies the instant when the second valve is uncovered but prior to gas entering the tubing at this point.

To satisfy the force balance requirement for unloading, Valve #1 must remain open to aerate the column of fluid from that point to the surface until Valve #2 is uncovered and gas starts entering the tubing at this point. When gas starts entering the tubing at the second valve, Valve #1 should close and remain closed. Therefore, Valve #'s 1 and 2 are spaced in accordance with maximum operating pressure. Whereas the set pressure of Valve #1 is also based on the operating pressure, the set pressure of Valve #2 is based on the reopening pressure of Valve #1. At this point, the conventional gas-lift design theory becomes quite critical. It is essential that an upper valve must not reopen for any reason while lifting from a lower valve. If this happens, valve interference will typically occur and it is quite likely that no further unloading will occur.

After the reopening pressure of valve #1 is established, this reopening pressure is then utilized in order to properly space Valve #3 in relation to Valve #2. It should be borne in mind that Valve #1 must remain closed while Valve #2 remais open during unloading operations until such time as Valve #3 is uncovered and gas begins to enter the tubing through Valve #3. At this point, if properly designed, Valve #2 should close and remain closed with gas entering the tubing only through open Valve #3. The next step in the design calculation concerns calculation of the reopening pressure (OP) of Valve #1 so as to establish proper spacing to Valve #3 and establish the set pressure of Valve #2. FIG. 14 is a graphical representation reflecting the detail of Valve 1 and 2. The dashed line represents the early theory that as gas begins to enter the tubing at Valve #2, casing pressure drops to the closing pressure (Pvc) of Valve #1 and there is a momentary increase in the density of the fluid flowing past Valve #1 with a resultant increase in pressure represented by Ptmax. The minimum pressure (Ptmin) occurs when the minimum gradient is once more achieved by the addition of more gas. The procedure then was to calculate the test rack opening pressure (Pvo) based on the minimum tubing pressure (Ptmin) and the reopening pressure (OP) based on the maximum pressure (Ptmax) since this would be the actual pressure available for unloading to Valve #3.

The following equations were derived for this purpose:

$$Pbt = (Pc@L)(1 - Ap/Ab) + Ptmin(Ap/Ab) \qquad \text{Equation 2.}$$

$$OP@L = \frac{Pbt}{(1 - Ap/Ab)} - Ptmax(TEF) \qquad \text{Equation 3.}$$

After the bellow charge at well temperature (Pbt) was determined and then converted to 60° F., the test rack opening pressure, i.e. the pressure determined by means of a test fixture into which the gas-lift valve is received, is calculated by the following equation:

$$P_{vo} = \frac{P_b}{(1 - Ap/Ab)} \qquad \text{Equation 4.}$$

The temperature at each valve depth are then estimated by reference to a chart identifying the flowing temperature gradient for different flow rates, geothermal gradients and tubing sizes. A chart of this nature is illustrated on Page 12–3 of a P.I. Paper No. 926-4-S. Corrections to a temperature of 60° F. may be accomplished by reference to a chart having correction factors. In the alternative, calculations can be accomplished using information obtained from charts for nitrogen charged bellows. The flowing temperature estimates were based on the maximum rate expected and it was assumed that a lesser rate would not affect the design.

After calculating the valve test rack opening pressure at 60° F. in accordance with Equation 4, calculations were then made to achieve spacing of Valve #3 in relation to Valve #2. With reference to FIG. 15, the reopening pressure of Valve #2 was calculated in accordance with the following equations:

$$Pbt_2 = (P_{c2}@L)(1 - Ap/Ab) + Pt_{2min}(Ap/Ab) \qquad \text{Equation 2.}$$

-continued $$OP_2@L = \frac{PBt_2}{(1 - Ap/Ab)} - Pt_2max(TEF) \quad \text{Equation 3.}$$

The reopening pressure ($OP_2$) was then plotted similar to the plot of OP, in accordance with FIG. 15 to determine the set pressure of Valve #3.

The minimum gradient technique was in wide use in the gas-lift industry until development of a technique referred to as the "optiflow" method which for the first time introduced the concept of employing "decreasing gradients" at each successively deeper valve of the gas-lift system. A similar fluid valve design is discussed on Pages 17-30 of the Macco gas-lift design manual pertaining to continuous flow installations relating to tubing sensitive valves. Other manufacturing organizations developed similar techniques through utilization of gas-lift valves that are considered highly tubing sensitive, but in all known cases the flowing temperatures were based on the maximum flow rate. Thus, valve interference remained a significant problem that resulted in the failure of many wells to be produced at the maximum production rate of the well. As mentioned above, when gas-lift valve interference develops, the liquid column within the well is not unloaded to the desired operating depth and the gas-lift system involved simply establishes a production rate that is substantially less than the maximum production rate of the well. Moreover, well production is also limited in many cases by a phenomenon typically referred to as "slugging." In this case the liquid column within the tubing is not properly serated and lightened in oder that it can be lifted efficiently to the surface. This improper aeration causes the liquid within the well to be forced to the surface in slugs or increments by the gas. Of course, much of the production fluid is retained by the surface tension of the tubing and descends back down through the tubing to a lower level where it again forms with other liquid as a slug or increment that is raised with gas.

In order to eliminate the problems of slugging and failure to unload to the desired operating level, gas-lift valve designs incorporating spring loaded, fluid operated valves were introduced. Utilization of spring loading rather than bellows operation rendered such valves insensitive to temperature. This method was highly successful in solving problems involving slugging and failure to properly unload to the desired operating level as in the case of the minimum gradient and optiflow techniques.

Early in the development of bellows charged gas-lift valve mechanisms, the design techniques were based upon accomplishment of valve closure by decreasing the pressure within the casing. It was subsequently determined, however, that any bellows charged casing pressure operated valve could be closed by simply reducing the tubing pressure to a predetermined pressure level. This meant that any valve could be used in conjunction with the "decreasing gradient" technique contrary to the then supposed design criteria that a particular kind of bellows charged gas-lift valve must be used. Although a number of design problems were overcome by innovations in pressure handling and valve design, there remained severe problems from the standpoint of temperature. Even though the gas-lift design techniques first assumed a constant flow rate with increasing gas-liquid ratios, it became more desirable to design for decreasing flow (liquid) rates instead. Again, there was the general assumption that estimating the high temperatures that would occur at each valve level represented the most conservative and safest approach for the design of gas-lift installations.

Obviously, laborious calculations were involved when gas-lift systems were designed in accordance with Equations 2 and 3 above. In order to simplify the design of gas-lift installations, many companies in the industry chose to accomplish design simplification by utilizing arbitrary drop in reopening pressures and thereby simplify the calculations involved in the design. In fact, some companies accomplished simplicity of design calculations without considering pressure drop at all but depended on the use of larger valve ports (higher tubing effect) in order to accomplish closure of the valves. These efforts toward simplicity of design calculations seemed to be an effort toward standardization and simplification of design techniques in order that the design of gas-lift systems could be "cook-booked" with minimum effort without unusual sacrifices from the standpoint of production.

One attempt to simplify gas-lift design took the form of an attempt to combine Equations 3 and 4 above and derive a temperature correction factor (Ct) chart in order that only one calculation step would be required in order to convert from down hole conditions to test rack opening pressure. The equation derived is as follows:

$$Pvo = [Pc@L + Pt@L(TEF)]Ct \quad \text{Equation 5.}$$

Where:

Pvo = Test rack opening pressure at 60° F., psig

Pc;@L = Reopening pressure at depths, psig

Pt@L = Minium tubing pressure at depth, psig

TEF = Tubing effect factor, percent $C_t$ = Temperature correction factor, no units From the graphical standpoint, a representation of the typical "decreasing gradient" design takes the form illustrated in FIG. 16. With reference to FIG. 16, the arbitary drop in reopening pressure varies from 10 psig for a 600 psig system to 30 psig for a 1,000 psig system. This "decreasing gradient" design technique is in wide use at the present time as is the "minimum gradient" technique described above for accomplishing design of gas-lift systems. Under circumstances where the particular production characteristics of the well closely correlate to the simplified design techniques that are presently utilized, the production of these wells is quite good. In many cases, however, these conventional design techniques fail to develop a gas-lift system that achieves production at the maximum capability of the well involved. For example, where gas-lift systems are designed in accordance with Equation 5, as depicted in FIG. 16, the geothermal temperatures at the level of the various gas-lift valves can become critical. With the technique shown to FIG. 16, the lower rate at each successively deeper valve often results in decreasing temperatures, which in turn means that two or more valves may be set at the same pressure. Compensation for this undesirable characteristic can sometimes be provided by an increase in port size of the various valve but, to do so, often introduces other problems that result in inefficiency of production. Ideally, the purpose of the "decreasing gradient" technique is to provide pots of accurate size in the valve primarily for the purpose of eliminating slugging. A solution that was suggested for correction of this problem is to revert to the previously used method of establishing 25 psig drops in test rack opening pressures regardless of the particular design characteristics called for at each level within the well. To do so, however, might result in an overall increase in productivity from the well but, this sort of arbitrary design would in effect result in forcing the well to conform to the nature of the equipment rather than tailoring the equipment in accordance with the conditions of the well itself. One attempted solution to the temperature problem resulting from design characteristics in accordance with Equation 4 was to provide a spring loaded casing pressure operated valve thereby overcoming the temperature sensitivity of conventional bellows type gas-lift valve mechanisms. However, the high spring rate of such valves which did not allow full opening was not considered to provide an effective solution to the temperature problem.

All of the known gas-lift design techniques to date, where temperature is considered for purposes of correction, provide temperature correction factors that consider only the maximum temperature that is expected at the level of a particular valve. In accordance with the teachings of the present invention, it is a primary feature to provide a technique for designing a gas-lift system that compensates or corrects for the lowest temperature that could be encountered at an upper valve while lifting from a lower valve.

The proposed method involves a variation and improvement of the standard equation 5 wherein the equation form is as follows:

$$PREO@L = Pc@L = (Pvo/Ct) - Pt@L(TEF) \qquad \text{Equation 5A.}$$

Where PREO@L=Reopening pressure at depth corrected to the actual temperature at the valve, psig.

It is also a feature of this invention to provide a novel gas-lift design technique wherein the high and low temperatures that might be encountered are predicted at the level of each valve.

An even further feature of this invention concerns the provision of a novel technique for designing gas-lift systems wherein the test rack opening pressures (Pvo) are based on the highest temperature possible at each valve whereas the reopening pressures for spacing lower valves are based on the lowest temperature possible at each valve.

It is an even further feature of this invention to provide a novel technique for designing gas-lift systems wherein the reopening pressures that are utilized for the purpose of spacing the next lower valve of any particular gas-lift system is based on the lowest predicted temperature that might be encountered at a particular valve.

Among the several features of this invention is noted a novel design technique for gas-lift systems wherein the reopening pressures (low temperature) are then utilized as the maximum operating pressure available at the next lower valves in a gas-lift system.

A further feature of the gas-lift design technique of this invention is to provide a means for adjusting test rack opening pressures and spacing of gas-lift valves so that the installation can perform efficiently over a wide range of conditions (mainly temperature variations) without the necessity for redesign. A further feature of this invention is to provide a novel technique for designing gas-lift systems that effectively eliminates excessive gas usage due to valve interference that ordinarily results when upper valves reopen and inject gas into the tubing, thus resulting in insufficient pressure for unloading to lower valves.

It is also a feature of this invention to provide a novel technique for designing gas-lift systems to prevent slugging which causes an excessively high pressure in the tubing and which in turn reduces production.

One of the more important features of this invention is to provide a novel technique for designing gas-lift systems that avoid abnormally wide valve spacing that can otherwise render the installation inoperative.

SUMMARY OF THE INVENTION

In accordance with the present invention, gas-lift design technique for designing gas-lift systems that are tailored to individual well criteria involves correcting the spacing and reopening pressures of each of the valves within the gas-lift system to the lowest temperature that could be encountered at an upper valve while lifting from a lower valve. The set pressures and spacing of each successively deeper valve are corrected for the lowest temperature that might be encountered during the life of the installation. Corrections can be made to correspond to lower flow rates at lower valves, lower temperatures during unloading operations with no feed-in, or corrections can be established all the way back to the geothermal gradient as in the case of a water drive zone that will initially produce 100% oil or outside mounted valves where the temperature of the valve is unpredictable.

In order to compensate for the cooler temperature involved during unloading with retrievable valves positioned inside the tubing in direct contact with the produced fluid, an average between the flowing temperature corresponding to the rate to be produced from the next deepest valve and the geothermal temperature is employed to calculate the reopening pressure of a given valve. In the event a high oil percentage is expected, correction of all valve reopening pressures is made down to geothermal temperature. For outside mounted valves (not in contact with the fluid), an average between the temperature of the fluid and the corresponding geothermal gradient (for the area involved) is used as the temperature of the gas at a given valve depth, this value should be used only for calculating the set pressures of the valves. The reopening pressures of these valves should always be corrected back to geothermal temperature for spacing and setting the next valve pressure (Pvo).

The gas-lift design technique of this invention can be effectively employed for establishment of combination gas-lift designs whether the valves are retrievable or outside mounted. A combination design consists of a continuous flow design in the upper part of the tubing string based on temperature corrections at each valve and an intermittent lift design in the lower part of the tubing string. The temperature of the intermittent portion of the installation is always equal to geothermal temperature and a correction must be made for the reopening pressure of the bottom constant flow valve. In other terms, the pressure available to operate the intermittent portion of a combination gas-lift installation is no more than the reopening pressure of the bottom continuous flow valve at geothermal temperature. For safety, the closing pressure at geothermal temperature is utilized rather than the reopening pressure. This applies to both retrievable and outside mounted valves.

BRIEF DESCRIPTION OF THE DRAWINGS

The present invention, both as to its organization and manner of operation, together with further objects and features thereof, may best be understood by way of schematic representation such as illustrated in the appended drawings, which drawings form a part of this specification. It is to be understood, however, that the appended drawings illustrate only typical embodiments of the invention and, therefore, are not to be considered limiting of its scope, for the invention may admit to other equally effective embodiments.

In the drawings.

DETAILED DESCRIPTION OF PREFERRED EMBODIMENT

In order to facilitate ready understanding of the present invention, it is deemed appropriate to identify prior art, gas-lift design techniques for comparison with the design technique forming the basis of the present invention. For this reason, FIGS. 12–16 and the descriptive matter associated therewith illustrate design concepts that form the prior art and illustrate in graphical and representative manner some of the problems that resulted in the development of the present invention.

Figure 1:
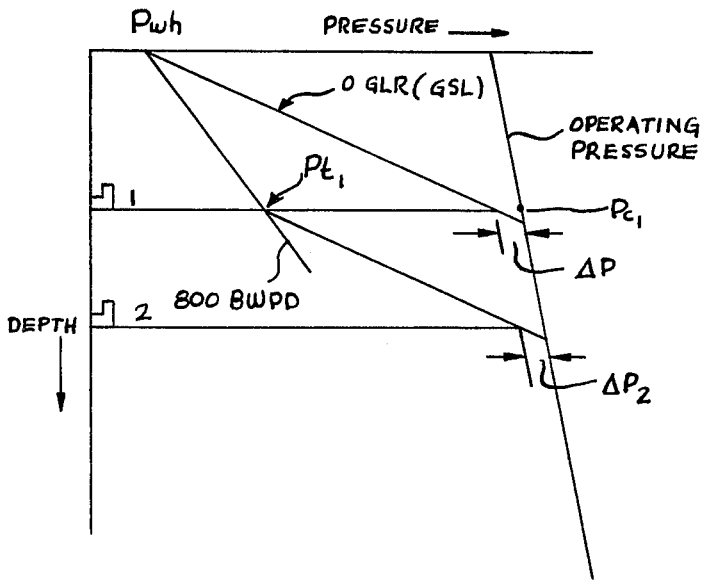
FIG. 1 is a graphical representation of a technique for designing a gas-lift system in accordance with the teachings of this invention, FIG. 1 showing only the design technique for spacing the first two gas-lift valves of the gas-lift system.
Figure 2:
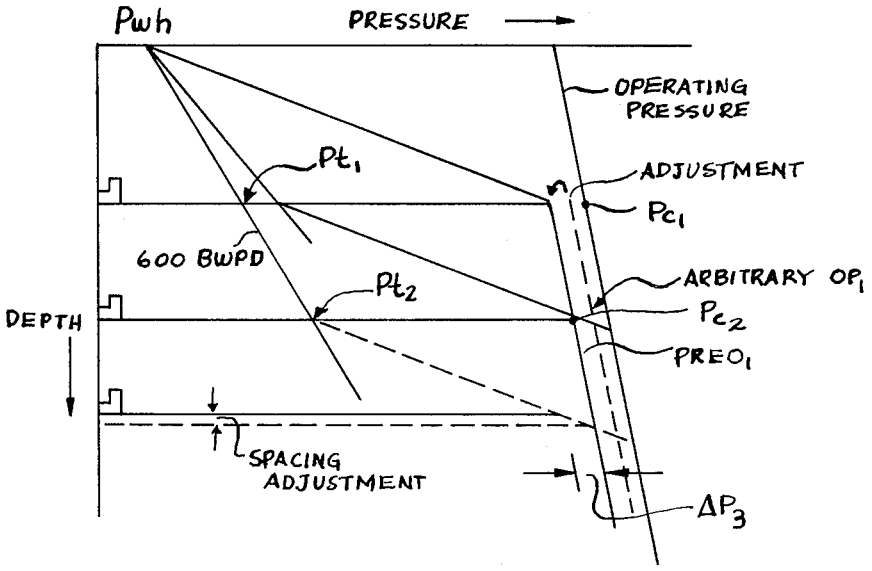
FIG. 2 is a graphical representation of the gas-lift design technique of this invention, particularly illustrating spacing and setting of the third valve of the gas-lift system in relation to Valves 1 and 2 together with other parameters utilized in the design technique.
Figure 3:
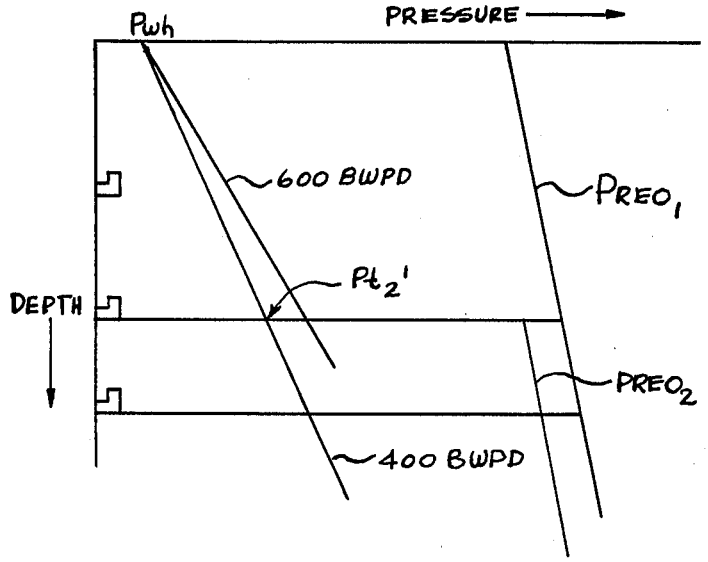
FIG. 3 is a graphical representation of the gas-lift design technique of this invention illustrating calculation of the reopening pressure of Valve #2 of the gas-lift system.

Referring now particularly to FIG. 1, the basic concept of the present invention is depicted in graphical terms. Basically, gas-lift design techniques in accordance with the present invention involve correcting the spacing and reopening pressures of the valves of a gas-lift system to the lowest temperature that could be encountered at an upper valve while lifting from a lower valve. Referring particularly to FIG. 2, the reopening pressure of Valve #2 would be corrected for a flowing temperature corresponding to an average between the flowing temperature at 600 BPD (or lower) and the geothermal temperature (unloading temperature) for the reason that the valve is caused to open at a lower pressure if the temperature decreases. The result is that there will be insufficient pressure to accomplish unloading to the level of Valve #3. In the former "decreasing gradient" technique, the opening pressure $OP_1$ would be based on the temperature for a production rate of 800 BPD. Therefore, in cases where the temperature decreases sufficiently, gas-lift valves in the upper portion of the tubing string that are intended to be closed will open at a lower than designed pressure and feed gas from the annulus into the tubing string. When this occurs, lower valves in the tubing string will be insufficiently supplied with gas (pressure) and will not introduce sufficient gas into the tubing to unload, thus resulting in the valve interference described above that results in ineffective production from the well.

There are four basic conditions in gas-lift design that must be accounted for at each valve in order to assure a successful installation. These basic conditions are: casing pressure, tubing pressure, gas requirements and temperature. Of these four basic conditions, temperature is the least predictable and yet affects the design as much if not more than the other three basic conditions. Temperature is also the basic design condition that is given least consideration in present gas-lift design. One example of a publication that concerns this is API Paper No. 926-4-S, which includes the teaching of predicting down hole flowing temperatures in the tubing string. The subject matter of this paper only applies to salt water, however, and only after the well is producing from the formation and therefore has feed-in from the production zone. The API paper does not consider a circumstance where the well is being unloaded and has no feed-in nor does the paper apply under circumstances where the production is 100% oil which generally flows at a temperature approximating the temperature of the geothermal gradient for the area involved. In the gas-lift industry, oil production flowing at geothermal gradient is considered "cold".

In gas-lift systems incorporating outside mounted valves that are nonretrievable, these valves are not in contact with the flowing fluid and are therefore at a lower temperature. Thus far it is not known how much lower the temperature is as compared to geothermal gradient. It has been assumed for quite some time that the temperature would equal the temperature of the injection gas which was thought to be equal to the geothermal temperature of the area for flow rate up to about 1,200 barrels of salt water per day. However, there is evidence that indicates that there is some temperature effect from the tubing even at much lower rates but at the present time there is no means for accurately predicting the temperature effect.

As mentioned above, the present design technique for gas-lift installations concerns correction of the set pressures and spacing of each successively deeper valve for the lowest temperature that might be encountered during the lift of the gas-lift installation. Corrections can be made to correspond to lower flow rates at lower valves or, in the extreme, corrections can be made even to the limits of geothermal gradient, as in the case of water drive zones that will initially produce 100% oil or outside mounted valves where the temperature of the valve is unpredictable.

FIGS. 1–5 illustrate step by step graphical presentation of the present temperature corrected technique for design of gas-lift production systems incorporating retrievable valves.

Step 1. Valve Nos. 1 and 2 are located in the conventional manner utilizing full line pressure. Valve #1 is spaced using the equation $L_1$=[Line Pressure-Wellhead Back Pressure] divided by static fluid gradient. The unloading rate at Valve #1 is arbitrary and is based on the maximum rate expected [for sake of this discussion the unloading rate is established at 800 BWPD (barrels water per day) as shown in FIG. 1]. Valve #2 is spaced graphically based on full line pressure.

Step 2. The test rack opening pressure of Valve #1 is calculated using casing pressure ($^{P}c_1$), tubing pressure ($^{P}t_1$) and estimating the temperature ($^{T}v_1$) at the valve. $^{P}c_1$ and $^{P}t_1$ are read directly from FIG. 1 while temperature is estimated using an area graph representing the flowing temperature gradient for the particular area involved. An example of an area graph or chart is illustrated in API Paper No. 926-4-S which depicts flowing temperature gradients for different flow rates, geothermal gradients and tubing sizes. Further, the port sizes are then based on the gas requirements and differential pressure ($^{P}c_1-{}^{P}t_1$) then using Equation 5, the opening pressure at 60° F. ($^{P}vo_1$) is calculated.

$$^{P}vo_1=[^{P}c_1@L+{}^{P}t_1(TEF)]Ct \qquad \text{Equation 5:}$$

Step 3. It is not necessary to plot the assumed reopening pressure ($OP_1$) for Valve #1 in the design graphy, but, for sake of illustration, the reopening pressure is plotted with the corresponding estimated spacing of Valve #3 (dash lines) in accordance with FIG. 2.

Step 4. The reopening pressure ($^{P}REO_1$) of Valve #1 is then calculated based on the minimum tubing pressure ($P'$ $t_1$) at the lower rate of 600 BWPD which occurs while lifting from Valve #2, the set pressure ($^{P}vo_1$), and the new temperature ($^{T}v_1$) for the lower rate using the following form of $$P_{vo1} = [P_{c1}@L + P_{t1}(TEF)]Ct \qquad \text{Equation 5.}$$

$$P_{REO1} = \frac{P_{vo1}}{Ct} - P'_{t1}(TEF) \qquad \text{Equation 5A}$$

5. The new reopening pressure is then plotted in graphically and which is shown as a heavy line in FIG. 2. The spacing of Valve #3 is then adjusted which is also represented by a heavy line.

Step 6. The set pressure ($^{P}vo_2$) of Valve #2 is then calculated based on $^{P}c_2$, $^{P}t_2$, port size required, and temperature ($^{T}v_2$) for 600 BWPD utilizing Equation 5 above.

Step 7. Assume a lower rate to be produced from Valve #3 and calculate the reopening pressure of Valve #2 in the manner set forth in FIG. 3 using Equation 5A above. From which:

$$P_{REO2} = \frac{P_{VO2}}{C_{t2}} = P'_{t2}(TEF)$$

Figure 4:
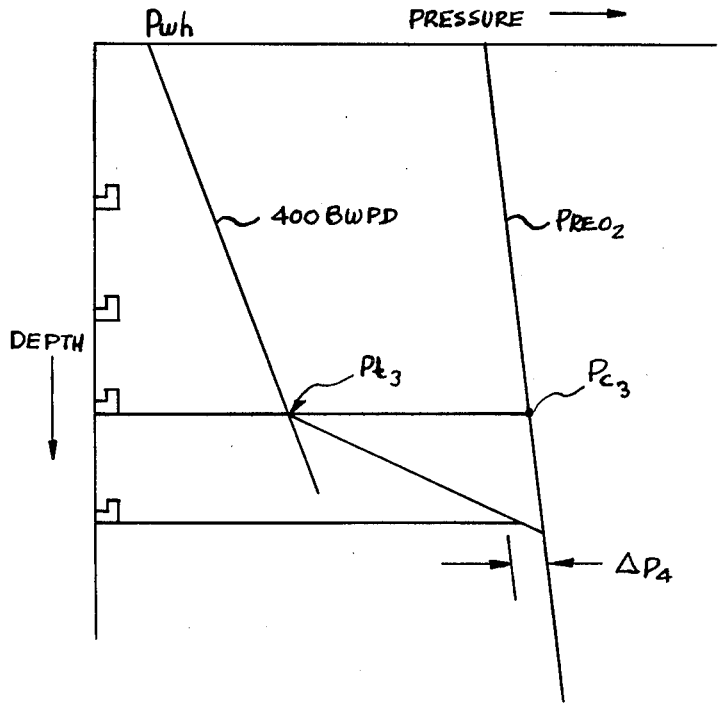
FIG. 4 is a further graphical representation of the gas-lift design technique of the present invention illustrating spacing of Valve #4 in relation to Valves 1, 2 and 3 of a particular gas-lift system.
Figure 5:
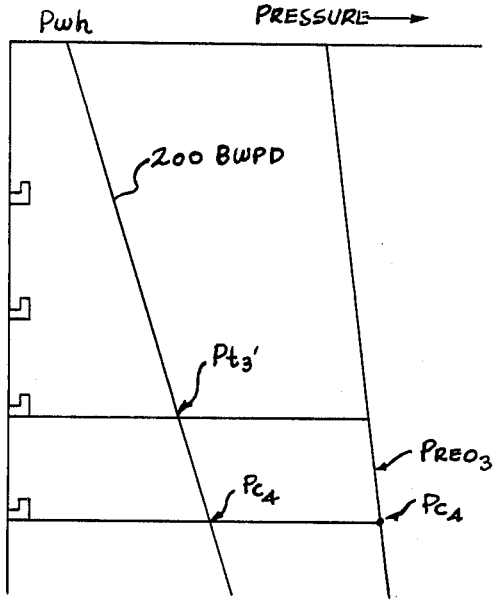
FIG. 5 is also a graphical representation of a gas-lift design technique illustrating calculation of the reopening pressure of Valve #3 utilizing the temperature corrected Equation 5A, which is a modification of Equation 5.

Step 8. Space Valve #4 using the reopening pressure of Valve #2 ($^{P}REO_2$) and $^{P}t_3$ which is the intersection of the 400 BWPD curve and horizontal depth line of Valve #3 as shown in FIG. 4.

Step 9. The set pressure ($^{P}VO_3$) of Valve #3 has been calculated based on $^{P}c_3$, $^{P}t_3$, port size required and temperature ($^{T}v_3$) for 400 BWPD using Equation 5.

Step 10. Assume a lower rate to be produced from Valve #4 and calculate the reopening pressure of Valve #3 using Equation 5A above. Then the reopening pressure of Valve #5 ($^{P}REO_3$) is plotted in the manner illustrated in FIG. 5.

Step 11. From FIG. 5, calculate the set pressure ($^{P}VO_4$) of Valve #4 based on $^{P}c_4$, $^{P}t_4$, port size required and temperature ($^{T}v_4$) for 200 BWPD using Equation 5.

I. Retrievable Bellows Charged Casing Pressure Operated Valves

Where retrievable casing pressure operated valves (bellows charged) are concerned, the difficulties involved in predicting flowing temperatures of the fluid in the tubing while gas-lifting at a given rate is well known. Moreover, there is no known method available to accomplish estimation of the temperature variations encountered while unloading where the rate of production from one valve depth to another can only be approximated. Even if a method could be devised for accurately predicting the temperature at any given instant at any given depth within the well, present gas-lift design techniques are inadequate to cover the wide range of variations that occur between the unloading and producing stages of operation. In the gas-lift industry under circumstances where a particular gas-lift design fails to produce a well at its full expected capacity, the oil production company involved is typically faced with the decision of redesigning the gas-lift system or accepting the lower rate of production. Where gas-lift systems are redesigned, a particular well may require redesigning several times until an acceptable rate of production is attained and this rate may or may not be the full production capacity of the well. It is therefore desirable to provide an improved design technique for installation of gas-lift systems that yields much more effective results as compared to the results obtained by present design techniques.

During development of the technique set forth herein, it was assumed in conjunction with experimental installations that the lowest temperature would occur at a given value while lifting from the valve immediately below. This assumption, however, is now considered to be inadequate for purposes of unloading. The various examples considered during this development indicate that a 15–30 psig decrease in reopening pressure between valves is sufficient allowance for a 200 BWPD (salt water) decrease in flow rate at the next deepest valve for an 800 psig and 1,000 psig injection gas system, respectively. But this indication does not take into account the cooler temperature involved during unloading or the variations introduced when the production is 100% oil.

It is, therefore, proposed that an average be established between the flowing temperature corresponding to the rate to be produced from the next deepest valve and the geothermal temperature which can then be employed for the purpose of calculating the reopening pressure of any given valve. Further, when a high oil percentage is expected (i.e. 100% oil), the reopening pressures of all of the valves should be corrected down to geothermal temperature.

II. Outside Mounted Bellows Charged Casing Pressure Operated Valves

Where outside mounted casing pressure operated valves (bellows charged) are concerned, there is no design technique presently available to predict the temperature of the injection gas in the casing annulus. There is evidence, however, that there is sufficient heat transfer from the fluid in the tubing to heat up the injection gas at high rates of flow. Again, however, even under circumstances where the temperature of a given valve can be predicted for a certain set of conditions, this predicted temperature would only apply at a particular instant during the variety of changes that the gas-lift system undergoes while transitioning from unloading to operating conditions. Such a temperature prediction would not make any allowance for the myriad of variable conditions that are encountered during gas-lift operations.

It is generally assumed that any drop in temperature (lower rate than expected) will not affect the unloading operation of the well since the drop in opening pressures will be offset by lower tubing pressures at the lower rates of production. This assumption has been accepted as a law of gas-lift and is the basis for all gas-lift designs that have occurred since the inception of nitrogen charged bellows type casing pressure operated valves. By correcting this basic law of gas-lift design for the lowest temperatures that might be encountered during the life of the gaslift installation, valve interference will be effectively eliminated and production will be substantially increased. In many cases, the lowest temperature that might be encountered during operation of any gas-lift system will be the geothermal gradient that exists in the area involved. Where the valves are outside mounted rather than retrievable, it is logical that corrections will be made substantially to the geothermal gradient. It is recommended that if an average between the temperature of the fluid and the corresponding geothermal gradient for the area of the producing field is utilized as the temperature of the gas at a given valve depth, this value should be used for calculating the set pressures only. The reopening pressures of the various gas-lift valves should always be corrected back to geothermal temperature for spacing and setting the next valve pressure ($P_{VO}$).

III. Combination Gas-Lift Designs

(Bellows Charged Casing Pressure Operated Valves)

A combination gas-lift design whether the valves are retrievable or outside mounted, consists of a continuous flow design in the upper portion of the tubing string and an intermittent lift design in the lower portion of the production string. The temperature of the intermittent portion of the installation is always equal to geothermal temperature and a correction must be made for the reopening pressure of the bottom constant flow valve. In other words, the pressure available to operate the intermittent portion of the installation is no more than the reopening pressure of the bottom continuous flow valve at geothermal temperature. For safety, the closing pressure at geothermal temperature is used rather than the reopening pressure.

The foregoing discussions of sections I, II and III above apply to the "decreasing gradient" technique of gas-lift production. The same principles, however, must be applied to "minimum gradient" designs in order to overcome similar problems of valve interference that are often encountered in gas-lift designs developed in accordance with the "minimum gradient" technique.

Figure 6:
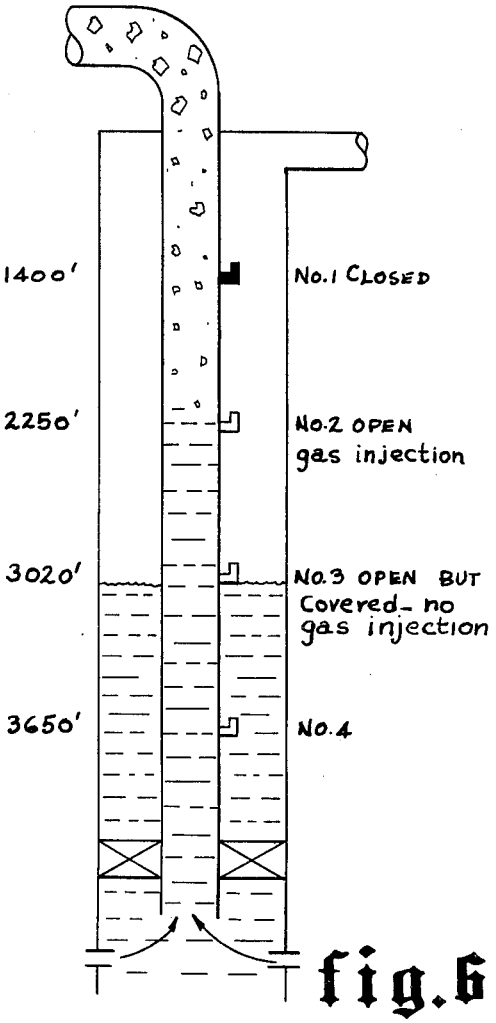
FIG. 6 is a pictorial representation of a typical oil well having a gas-lift system for production thereof and relates to determination of the lowest probable temperature that might be encountered at Valve #1 and the subsequent reopening pressure of Valve #1.

It is important to an understanding of the present invention that the effect of temperature be identified in all phases of gas-lift production. The following temperature predictions descriptively and graphically represent the more critical phases of gas-lift operation and the resulting temperature phenomenon thereof. Reference is made to FIG. 6 which is a pictorial illustration of a well during unloading activity.

I. Unloading (Salt Water)

Assume that Valve #3 is uncovered, gas is being injected through Valve #2, and Valve #1 is closed. What would be the lowest probable temperature at Valve #1 and its subsequent reopening pressure (with no feed-in occurring from the formation)?

1. There is at least a 7° F. cooling effect from gas entering the tubing at Valve #2.

2. Without feed-in of fluid from the formation, the fluid being produced is the volume being transferred from the casing into the tubing through Valve #4. This fluid production is normally at a lower production rate than will be achieved after feed-in from the formation is initiated.

It can then be assumed that the temperature at Valve #1 will be no higher than the average between the geothermal temperature of the fluid from Valve #2 to Valve #5 less 7° F. of cooling from gas injection into the tubing through Valve #1.

Figure 6A:
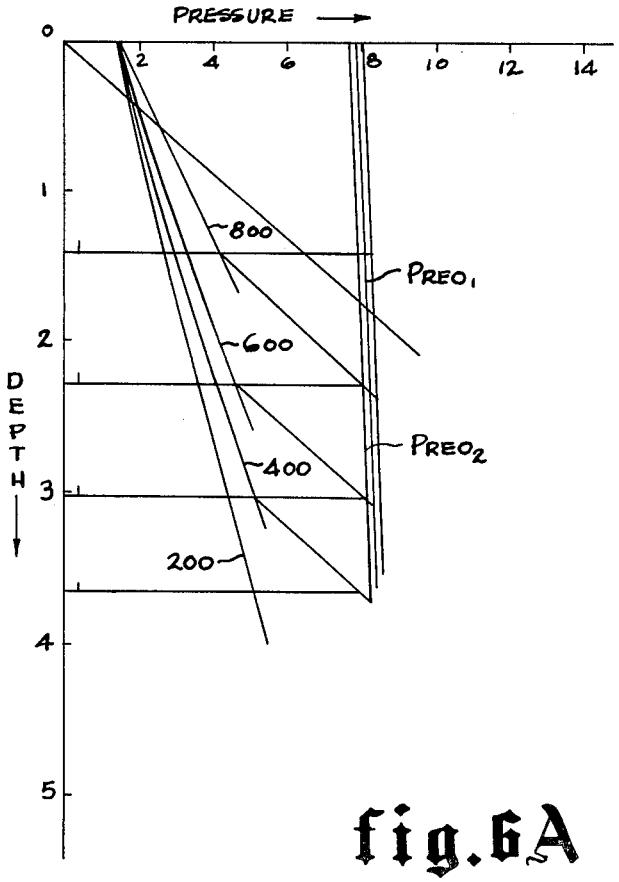
FIG. 6A is a graphical representation of a temperature corrected gas-lift production system designed in accordance with the well parameters of FIG. 6.

Using data from FIG. 6A:

$$T_{v}avg = \frac{103 + 121}{2} = 112° \text{ F.}$$

$$Min\ temp = 112 - 7 = 105° \text{ F.}$$

$$Ct = 0.912$$

Assume an unloading Pt the same as 600 BF rate.

$$P_{REO1} = \frac{710}{0.912} - 333\ (0.04)$$

$$= 778 - 13 = 765 \text{ psig @ } L_1$$

$$P_{REO1} \text{ @ } surf = \frac{765}{1.03556} = 739 \text{ psig}$$

Conclusion: The surface design pressure was 785 psig which is 46 psig higher than is actually available to inject at Valve #3 which will result in a stymie condition, i.e. Valve #1 reopens before gas can enter the tubing at Valve #3.

II. Operating (Feed-in of Salt Water)

Assume the rate of feed-in is no more than 200 BWPD while lifting from Valve #2 (low GLR) then the temperature at Valve #1 (ignoring possible dilution from casing fluid) would be:

$$T_{v1} = 204° - 86\ (2.086) - 7°$$
$$= 104° \text{ F.}$$

Again, a stymie condition (1° F. less than the average temperature calculated in Part I above).

III. Operating Condition (Feed-in of Oil)

With oil, (100%) the flowing temperature will be roughly equal to the geothermal gradient for the area. Therefore, the temperature at Valve #1 while lifting from Valve #2 is:

$$T_{v1} = 1.3\ (14) + 74° \text{ F.} - 7° \text{ F.}$$
$$= 85° \text{ F.}$$

This would be, without question, a stymie condition, since the lowest temperature is 20° F. less than the average temperature calculated in Part I.

In order to determine the average between flowing temperature (salt water) and geothermal temperature:

From Part II above:

$$T_{V600} = 204° \text{ F.} - (100 - 14)(0.753)$$
$$= 204 - 65 = 143° \text{ F.} - 7 = 136° \text{ F.}$$
$$T_{Vgeo} = 1.3\ (14) + 74 = 92 - 7 = 85° \text{ F.}$$

From which:

$$T_{Vavg} = \frac{85° \text{ F.} + 136° \text{ F.}}{2} = 111° \text{ F.}$$

Figure 7:
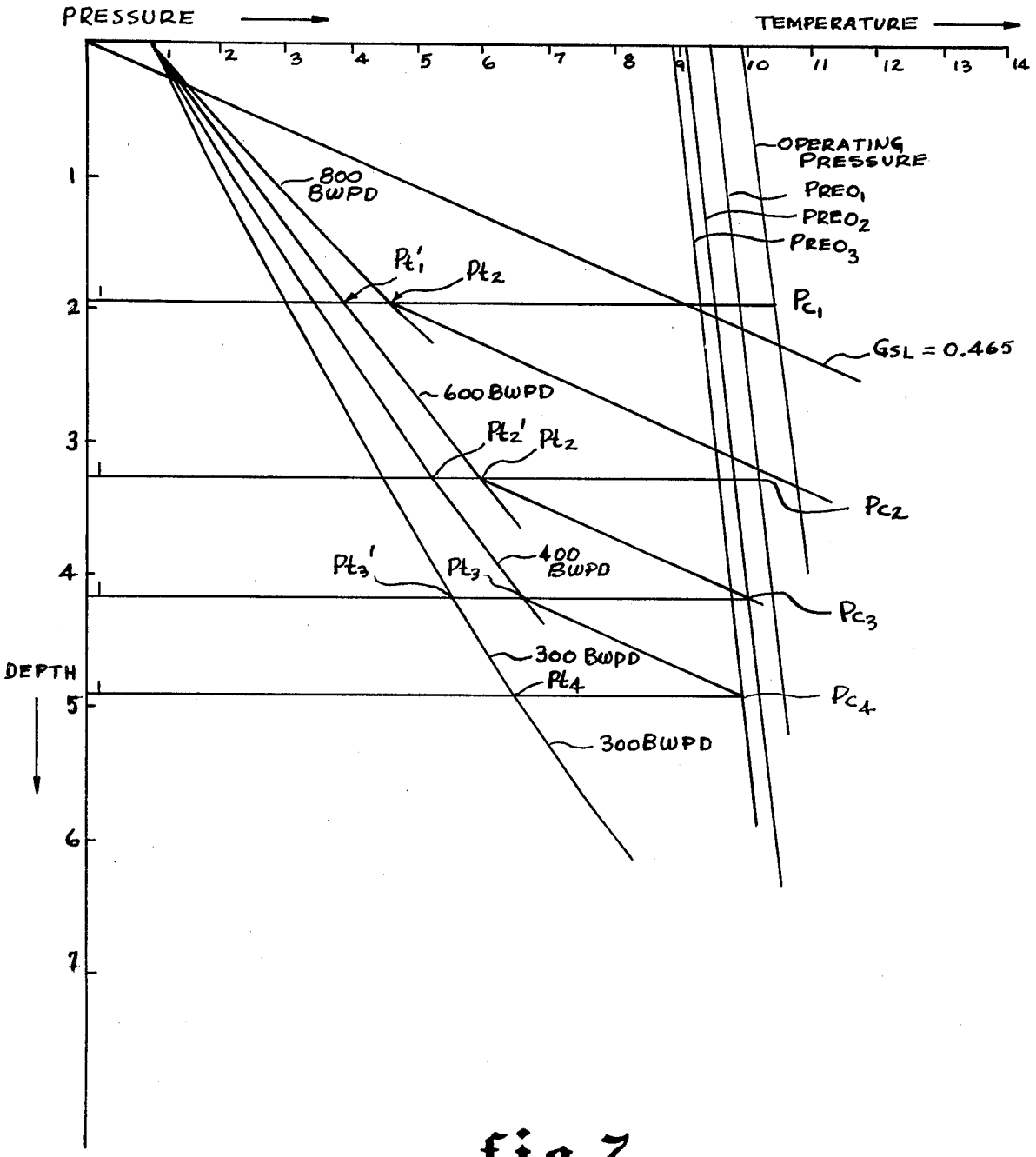
FIG. 7 is a graphical representation illustrating a gas-lift production installation with valve spacing and opening and reopening pressures of the valves being corrected to the average temperature between geothermal temperature and flowing temperature.

Following are sample calculations relating to FIGS. 7–11, depicting application of the present invention to various generally accepted design techniques. FIG. 7 is a graphical representation of a continuous flow type gas-lift installation with corrections to average temperature where the depth of the perforations for the formation being produced is 10,000 feet, injection gas pressure is 1,000 psig, tubing size is $2\frac{3}{8}$ inches, fluid production is estimated at 800 BWPD with the percentage of water being 100%. Back pressure of the well is 100 psi with the bottom hole temperature being 204° F. (1.3° F. per 100 feet + 74° F.). The fluid surface temperature is indicated as being variable. Sample calculations for the gas-lift installation set forth in FIG. 7 are indicated in step-by-step manner as follows:

EXAMPLE I

I. Valve #1

Step 1. Calculate the depth of Valve #1:

$$L_1 = \frac{P_{op} \text{ @ } Surf. - Pwh}{G_{SL}} = \frac{1{,}000 - 100}{0.465} = 1{,}935 \text{ feet}$$

Step 2. Calculate the geothermal temperature at $L_1$:

$$T_{v1geo} = \frac{G_{T(Depth)}}{100 \text{ feet}} + T_{mean}$$

$$= 1.3° \text{ F./100' (1,935')} + 74° \text{ F.}$$

$$= 99° \text{ F.}$$

Step 3. Calculate the average temperature of the gas in °Rankine:

$$T_{Vavg} = \frac{T_{geo} + T_{mean}}{2} + 460° \text{ F.} = \frac{99° + 74°}{2} + 460°$$

$$= 547° \text{ R}$$

Step 4. Calculate the operating pressure at $L_1$:

$$P_{C1} = P_{Csurf} e^{\left[\frac{0.0135525(L1)}{Tavg}\right]}$$

$$= 1000 \text{ psig } e^{\left[\frac{0.0135525\ (1935)}{547}\right]} = 1000\ (1.0491)$$

$$= 1049 \text{ psig}$$

Step 5. Calculate the flowing temperature at Valve #1:

$$T_{V1} = BHT - \frac{(perf. - L_1)}{100 \text{ feet}} \text{ (Temp. Grad.)}$$

$$= 204° - (100 - 19.35)(0.653)$$

$$= 151° \text{ F. @ 800 } BWPD$$

Step 6. Calculate the test rack opening pressure of Valve #1 @ 60° F.:

$$P_{VO1} = [P_{C1} \text{ @ } L_1 + Pt(TEF)](Ct)$$
$$= [1{,}049 + 463\ (0.04)](0.836) = 893 \text{ psig}$$

Step 7. Calculate the average temperature at Valve #1 while lifting 600 BWPD from Valve #2:

A. Temperature at 600 BPD:

$$T_V = BHT - \frac{(Perf. - L_1)}{100 \text{ feet}} \text{ (Temp. Grad.)}$$

$$= 204 - (80.65)(0.755) = 143° \text{ F.}$$

B. Average between flowing and geothermal temperatures:

$$T'_{V1} = \frac{143° + 99°}{2} = 121° \text{ F.}$$

Step 8. Calculate reopening pressure of Valve #1 at $^{T}V_1'$:

$$P_{REO1} = \frac{P_{vo}}{Ct} - Pt'(TEF)$$

$$= \frac{893}{0.884} - 393\ (0.04)$$

$$= 994 \text{ psig @ depth}$$

Step 9. Calculate $^{P}REO_1$ at the surface $$P_{REO1} = \frac{994}{e^{\frac{0.0135525\ (1,935)}{547}}} = 947 \text{ psig @ surface}$$

Step 10. Calculate $^{P}REO_1$ @ the depth of Valve #2:

$$P_{REO1} @ L_2 = P_{REO1surf}\, e^{\left[\frac{0.0135525\ (3,240)}{555}\right]}$$

$$= 747\ (1.0823) = 1,025 \text{ psig}$$

II. Valve #2

Step 1. Calculate geothermal temperature at $L_2$:

$$^{T}V_{2geo} = 1.3° \text{ F./100' } (3,240') + 74° \text{ F.} = 116° \text{ F.}$$

Step 2. Calculate the flowing temperature at $L_2$:

$$^{T}V_2 = 204° \text{ F.} - (100 - 32.4)(0.755) = 153° \text{ F.}$$

Step 3. Calculate the test rack opening pressure of Valve #2:

$$^{P}VO_2 = (1,025 + 24)(0.83) = 874 \text{ psig}$$

Step 4. Calculate the average temperature of the fluid at $L_2$:

A. Temperature at 400 BWPD:

$$^{T}V_2 = 204° \text{ F.} - (67.6)(0.9) = 143° \text{ F.}$$

B. Average between flowing and geothermal temperatures:

$$^{T}V_2' = (143° + 116°)/2 = 130° \text{ F.}$$

Step 5. Calculate the reopening pressure of Valve #2 at $^{T}V_2'$:

$$^{P}REO_2 = (874/0.869) - 527\ (0.04) = 985 \text{ psig @ depth}$$

Step 6. Calculate $^{P}REO_2$ at the surface:

$$P_{REO2} @ surf. = \frac{985}{e^{\frac{0.0135525\ (3,240)}{555}}}$$

$$= 910 \text{ psig}$$

Step 7. Calculate $^{P}REO_2$ at the depth of Valve #3:

$$P_{REO2} @ L_3 = 910\ e^{\left[\frac{0.0135525\ (4,150)}{561}\right]}$$

$$= 910\ (1.1055) = 1,006 \text{ psig}$$

III. Valve #3

Step 1. Calculate the geothermal temperature @ $L_3$:

$$^{T}V_{3geo} = 1.3° \text{ F. } (41.5 \text{ ft.}) + 74° \text{ F.} = 128° \text{ F.}$$

Step 2. Calculate the flowing temperature @ $L_3$:

$$^{T}V_3 = 204° \text{ F.} - (100 - 41.5)(0.9) = 151° \text{ F.}$$

Step 3. Calculate the test rack opening pressure of Valve #3:

$$^{P}VO_3 = (1,006 + 27)(0.836) = 864 \text{ psig}$$

Step 4. Calculate the average temperature of the fluid @ $L_3$

A. Temperature @ 300 BWPD $$^{T}V_3 = 204° - (58.5)(0.987)$$
$$= 146° \text{ F.}$$

B. Average between flowing and geothermal temperatures:

$$^{T}V_3' = (146° + 128°)/2 = 137° \text{ F.}$$

Step 5. Calculate the reopening pressure of Valve #3 at $^{T}V_3'$:

$$^{P}REO_3 = (864/0.858) - 557\ (0.04) = 985 \text{ psig @ depth}$$

Step 6. Calculate $^{P}REO_3$ at the surface:

$$P_{REO3surf} = \frac{985}{e^{\frac{0.0135525\ (4150)}{561}}} = \frac{985}{1.1055} = 891 \text{ psig}$$

Step 7. Calculate $^{P}REO_3$ at the depth of Valve #4:

$$P_{REO3} @ L_4 = 891\ e^{\left[\frac{0.0135525\ (4.890)}{566}\right]}$$

$$= 891\ (1.1242) = 1,002 \text{ psig}$$

IV. Valve #4

Step 1. Calculate the flowing temperature at Valve #4:

$$^{T}V_4 = 204° \text{ F.} - (100 - 48.9)(0.987) = 154° \text{ F.}$$

Step 2. Calculate the test rack opening pressure of Valve #4:

$$^{P}VO_4 = (1002 + 26)(0.832) = 855 \text{ psig}$$

Figure 8:
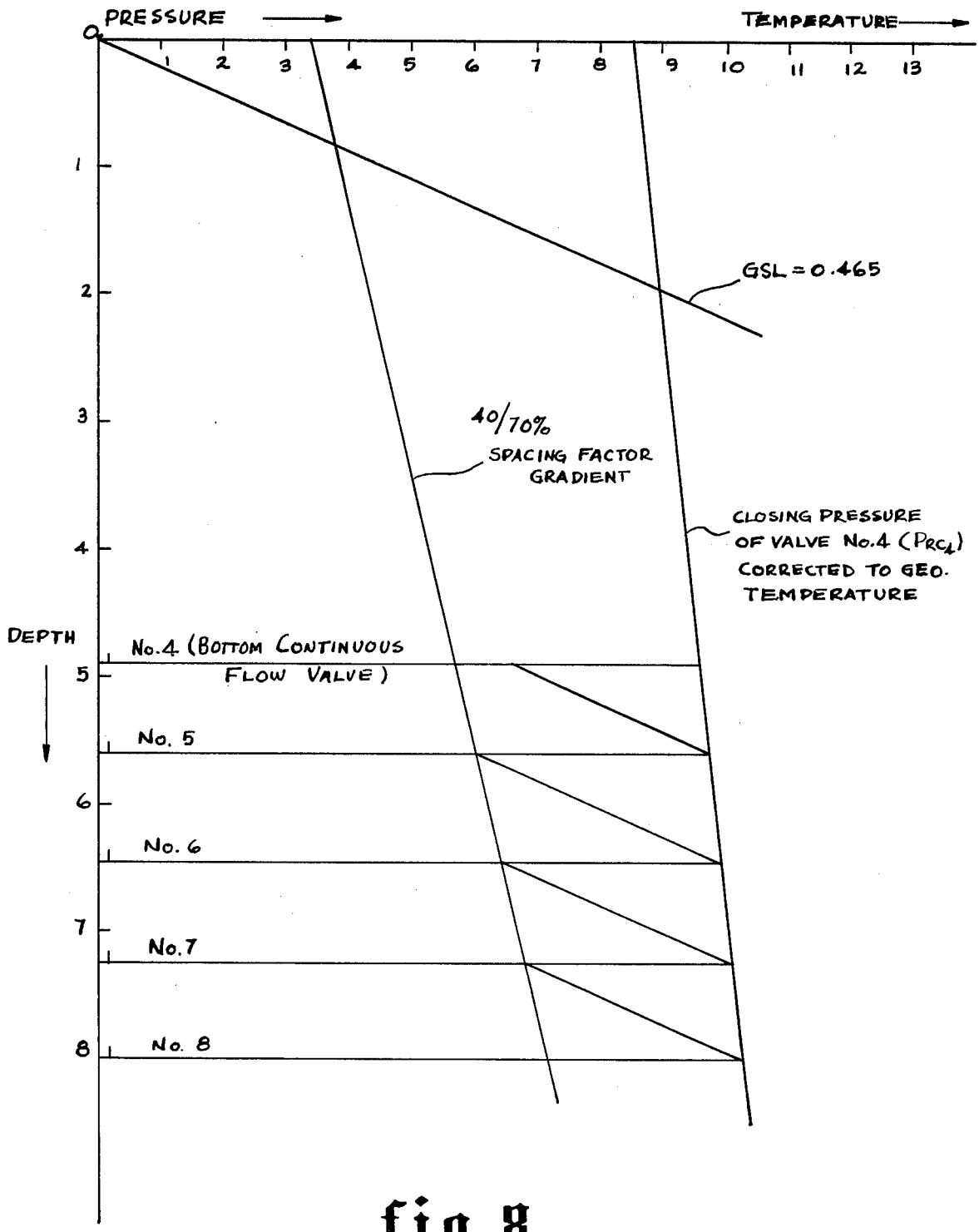
FIG. 8 is a graphical representation illustrating the lower or intermittent portion of a combination gas-lift production system with corrections to geothermal temperature.

It should be borne in mind that the continuous flow gas-lift installation of FIG. 7 can be a unitary installation where all of the valves function in accordance with the continuous flow type of gas-lift. Alternatively, and as shown in FIG. 8, a combination type gas-lift system is depicted graphically with Valve #4 being the bottom continuous flow valve of a continuous flow portion of the system.

Figure 9:
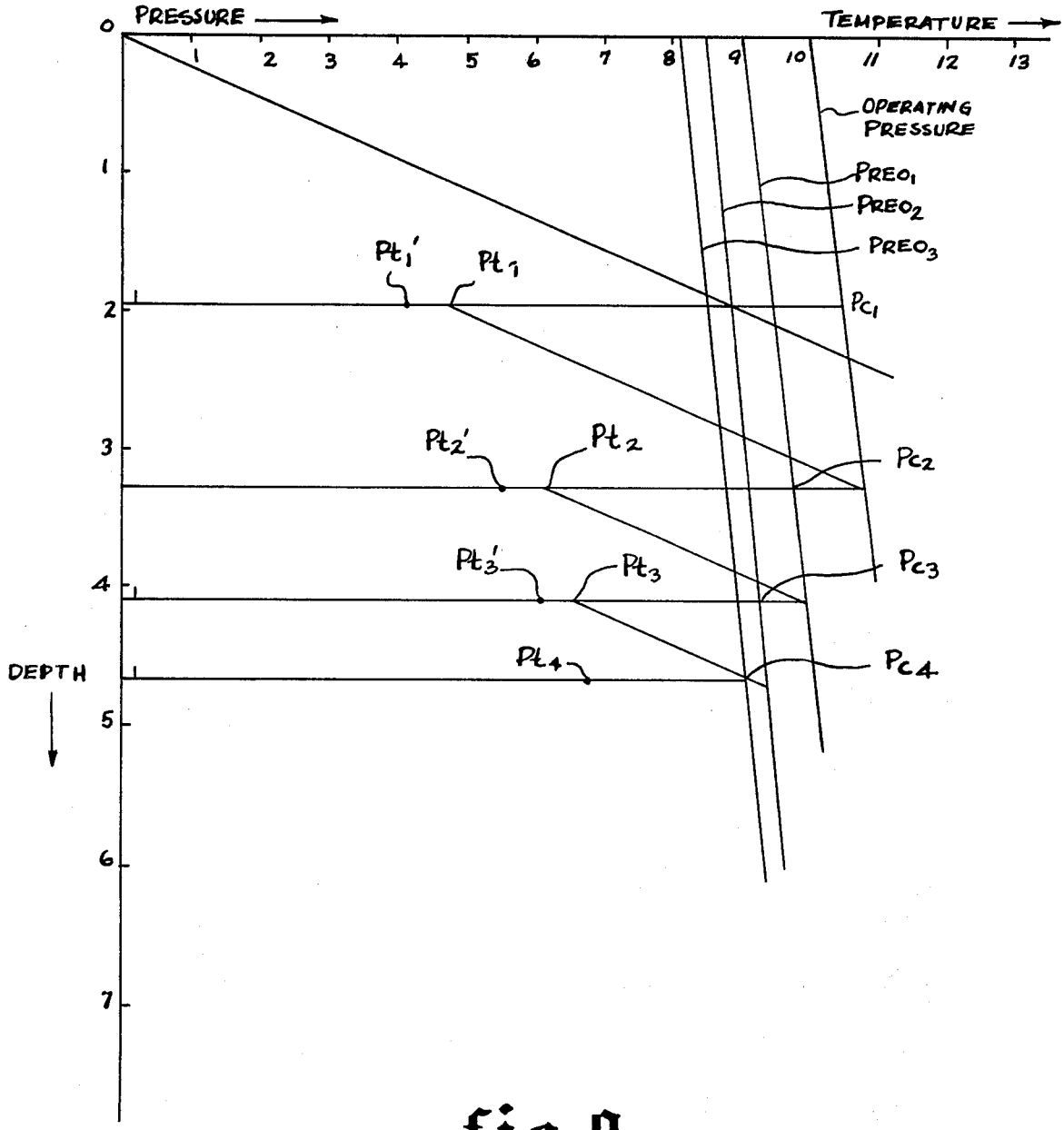
FIG. 9 is a graphical representation of a continuous flow type gas-lift production system having corrections to geothermal temperature.

FIG. 9 illustrates the reduction of reopening pressure graphically shown by lines PREO 1, PREO 2, and PREO 3, and the resulting excess shift in set depths for a continuous flow type gas-lift production system adjusted for the increase in geothermal temperature, not the minimum operating temperature that increased with each deeper valve. All gradients are shown parallel to the non-aerated liquid gradient and production is limited to 4700 feet, where the continuous lifting valve is positioned, not deep enough for maximum production.

Figure 10:
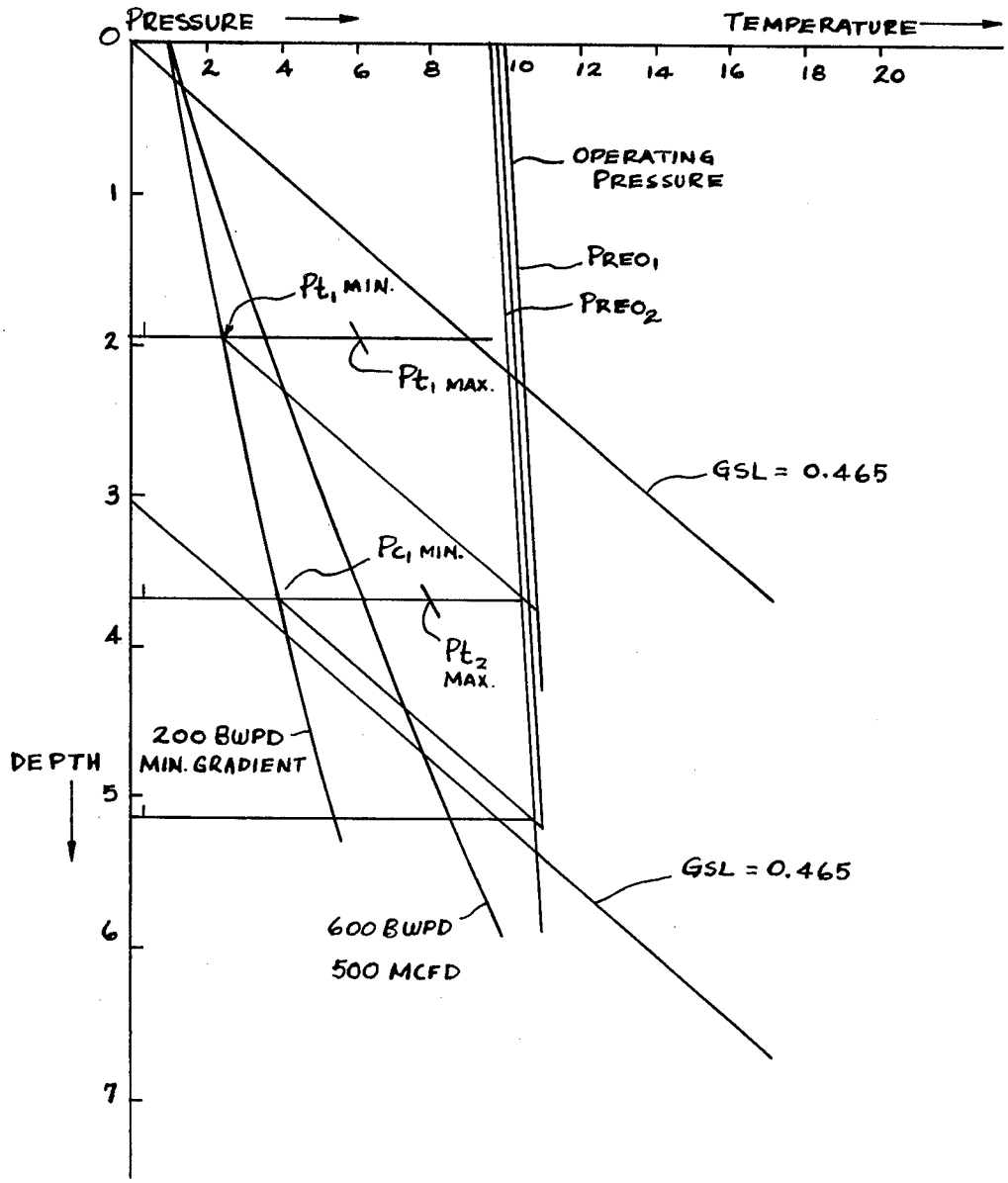
FIG. 10 is a graphical representation illustrating a continuous flow type gas-lift production system utilizing the minimum tubing gradient for unloading (not corrected for lower temperatures).

FIG. 10 also represents a continuous flow type gas-lift system but one based on the minimum tubing gradient as depicted by lines of reducing flow rates as at 600 BWPD and 200 BWPD. The lifting valve may then be positioned deeper as at 5100 feet due to gradients being based on a lighter fluid mixture.

Figure 11:
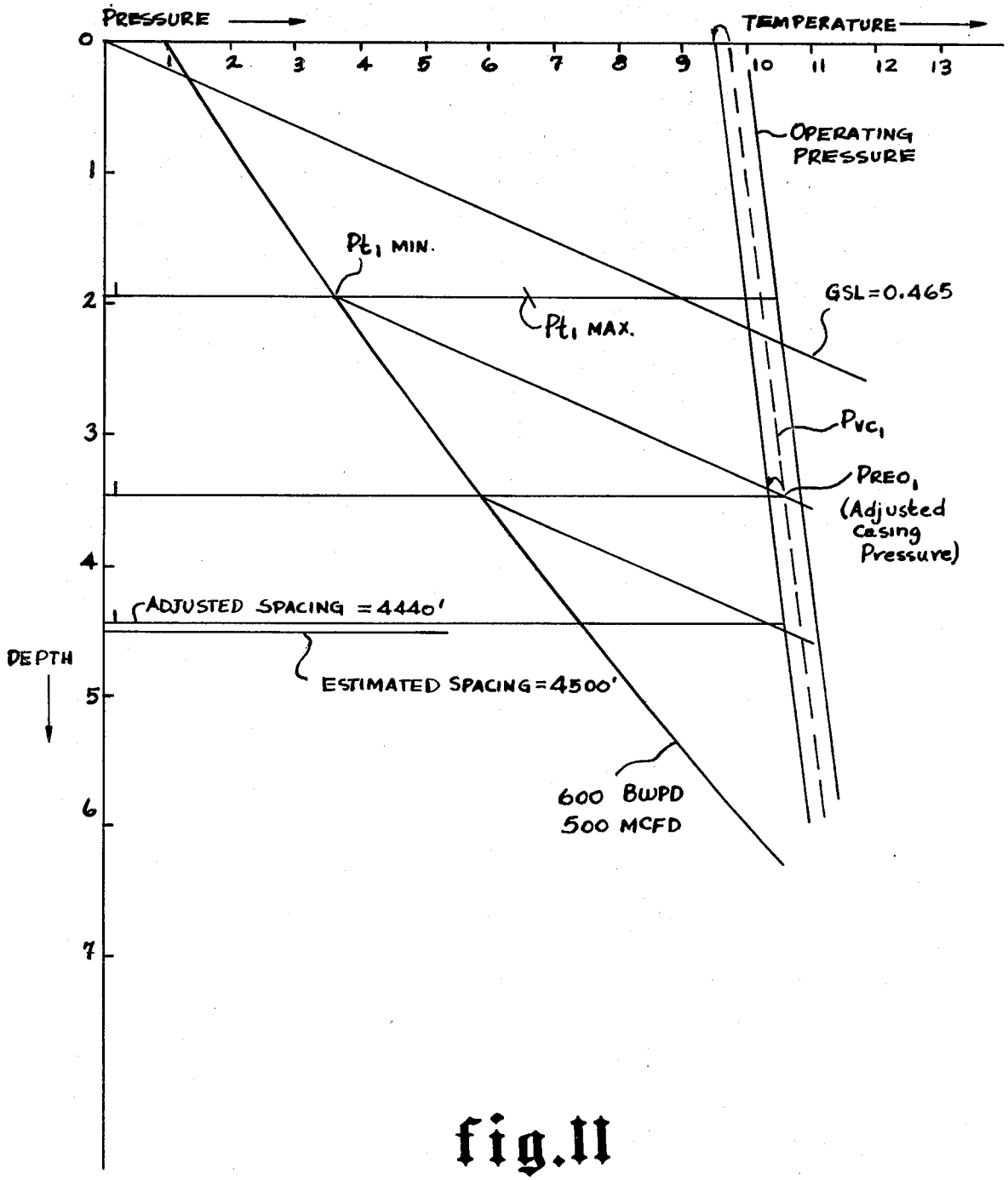
FIG. 11 is a graphical representation of a temperature corrected continuous flow type gas-lift production system based on the minimum gradient design.
Figure 12:
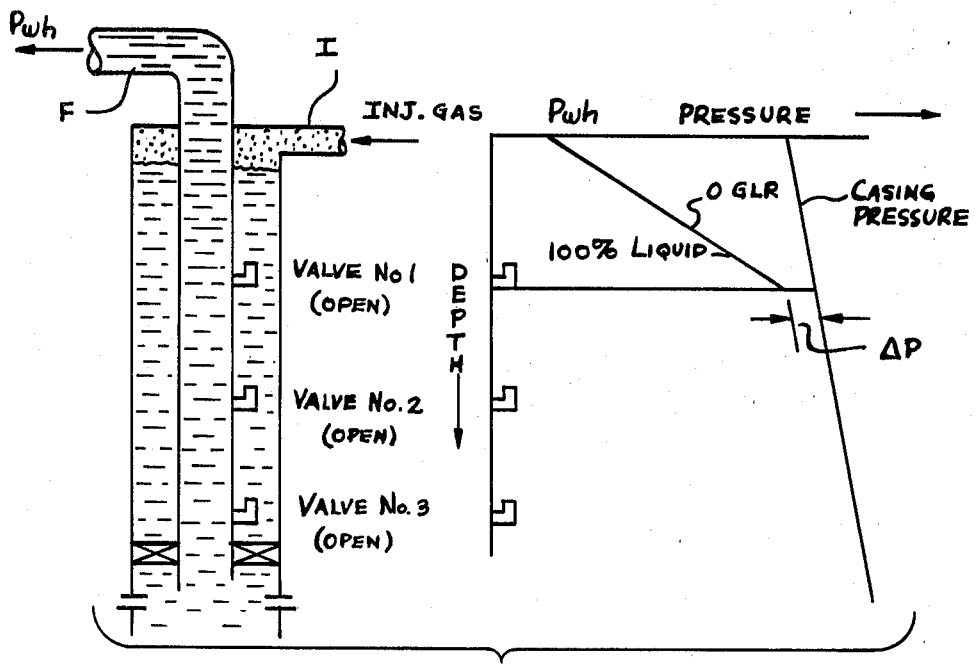
FIG. 12 is a combination pictorial and graphical representation illustrating the condition of a gas-lift produced well at the time injection of gas is initiated.
Figure 13:
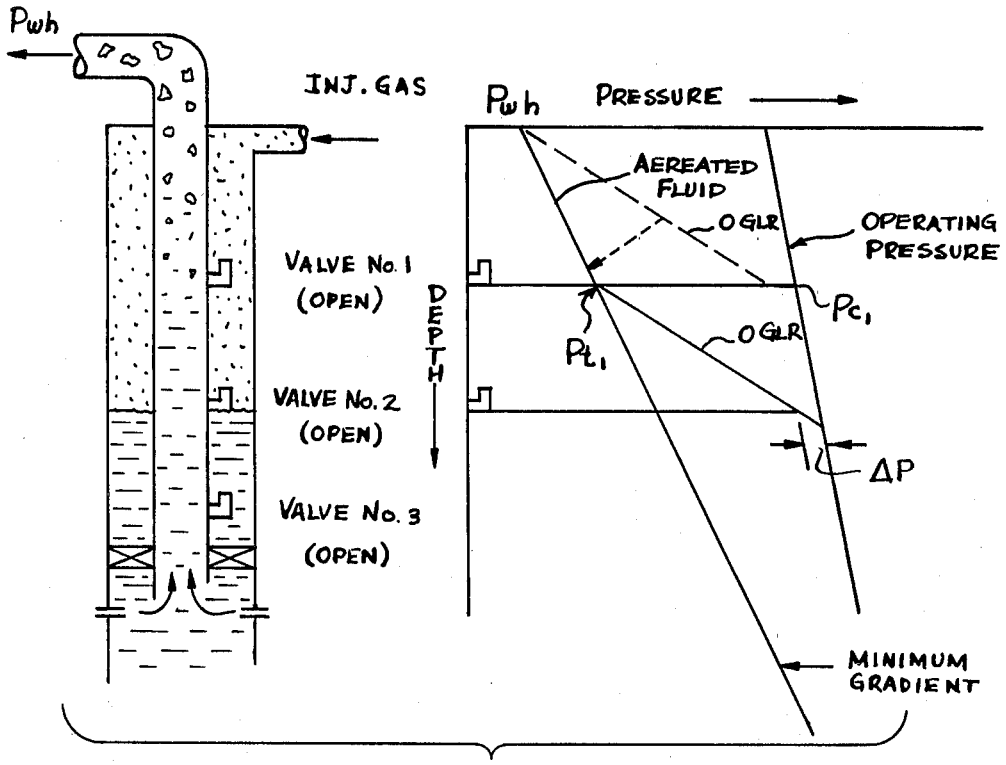
FIG. 13 is also a pictorial and graphical representation of a conventional gas-lift produced well, illustrating the "minimum gradient" technique and showing fluid having been unloaded to a level uncovering the second gas-lift valve.
Figure 14:
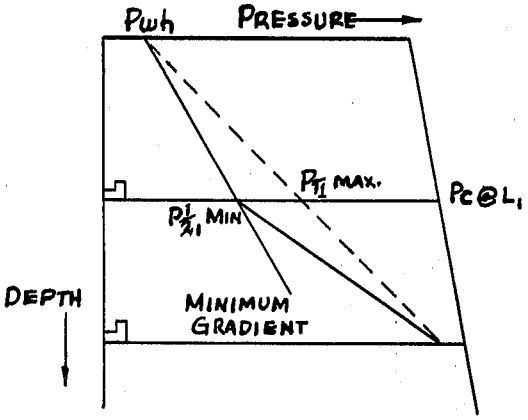
FIG. 14 is a graphical representation of the "minimum gradient" technique of gas-lift design, illustrating maximum and minimum tubing pressures used in setting and determining the test rack opening and the reopening pressure of Valve #1.
Figure 16:
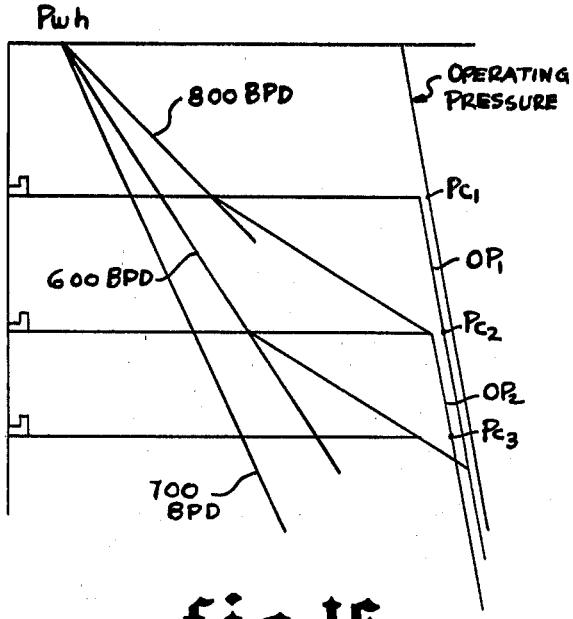
FIG. 16 is a graphical representation of a typical "decreasing gradient" design technique for installation of gas-lift systems.
Figure 15:
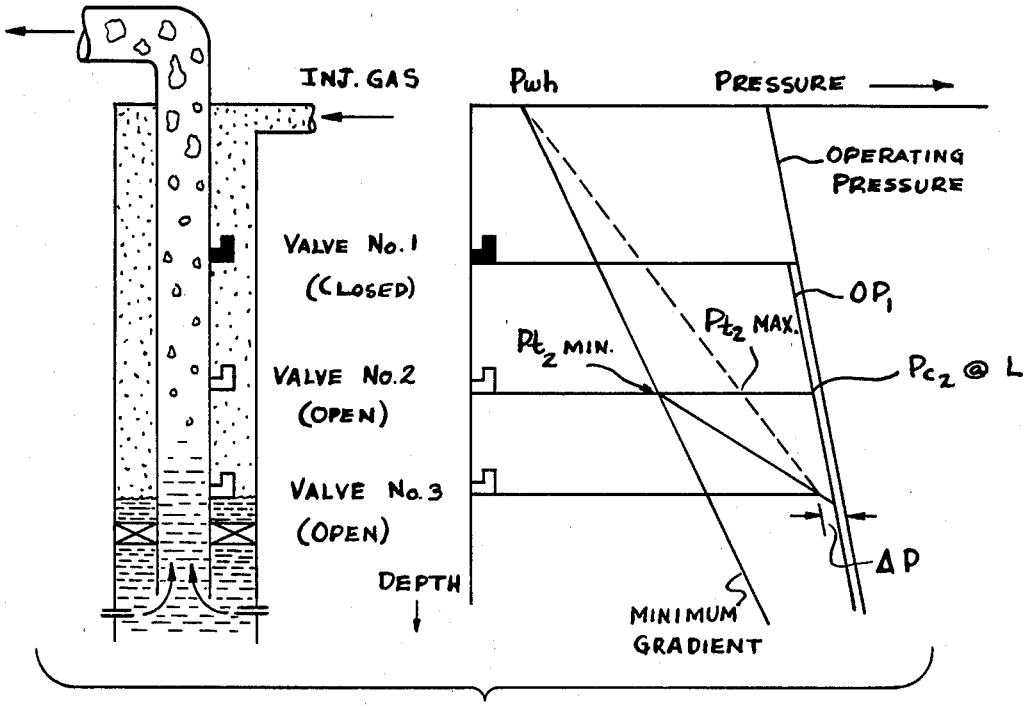
FIG. 15 is a combination pictorial and graphical representation of the "minimum gradient" technique of gas-lift design showing the well to have been fully unloaded, illustrating Valve #1 as being closed while Valves 2 and 3 are maintained open. The graphical representation illustrates spacing of Valve #3 in relation to Valves 1 and 2.

FIG. 11 is the same as FIG. 10 except that temperature corrections have been added for the spacing of the third valve from the top, resulting in a slightly lesser depth for that valve and likewise for all lower valves.

What is claimed is:

1. A method of spacing and pressure setting gas-lift valves of a gas-lift production system according to the production characteristics of liquid producing wells, said method comprising:

establishing the spacing of the various gas-lift valves relative to the surface;

establishing the reopening pressure settings of said gas-lift valves; and correcting the spacing and reopening pressures of said gas-lift valves to accommodate the lowest temperature that could be encountered at any one of the valves while lifting from a lower valve.

2. The method of claim 1, wherein:

said temperature corrections are made to the geothermal gradient for the area of the formation being produced when the production zone produces substantially 100% oil.

3. The method of claim 1, wherein:

said temperature corrections are made to the geothermal gradient for the area of the formation being produced under circumstances where outside type gas-lift valves are employed and the temperature at the level of the vaves is unpredictable.

4. The method of claim 1, wherein the reopening pressure of each valve of said gas-lift production system is temperature corrected by:

utilizing the average temperature between the flowing temperature corresponding to the rate to be produced and the geothermal temperature.

5. The method of claim 1, wherein the reopening pressure of each valve of said gas-lift production system is corrected by:

utilizing the geothermal gradient as the temperature correction factor when the production fluid contains a high percentage of oil.

* * * * *